US005108580A

United States Patent [19]

Nongbri et al.

[11] Patent Number: 5,108,580

[45] Date of Patent: Apr. 28, 1992

[54] TWO CATALYST STAGE HYDROCARBON CRACKING PROCESS

[75] Inventors: Govanon Nongbri, Port Neches; Gerald V. Nelson, Nederland; Roy E. Pratt, Port Neches; Charles H. Schrader, Groves, all of Tex.; William B. Livingston, Baton Rouge, La.; Michael P. Bellinger, Baton Rouge, La.; Scott M. Sayles, Baton Rouge, La.

[73] Assignee: Texaco Inc., White Plains, N.Y.

[21] Appl. No.: 320,432

[22] Filed: Mar. 8, 1989

[51] Int. Cl.[5] ..... C10G 69/04

[52] U.S. Cl. ..... 208/61; 208/68; 208/155; 208/162; 208/113

[58] Field of Search ..... 208/68, 100, 61, 67, 208/113, 155, 162

[56] References Cited

U.S. PATENT DOCUMENTS

| | | | |
|---|---|---|---|
| Re. 25,770 | 4/1965 | Johanson | 208/10 |
| 3,135,682 | 6/1964 | Mason et al. | 208/68 |
| 3,245,900 | 4/1966 | Paterson | 208/68 |
| 3,412,010 | 11/1968 | Alpert et al. | 208/112 |
| 3,681,231 | 8/1972 | Alpert et al. | 208/59 |
| 3,905,892 | 9/1975 | Gregoli et al. | 208/95 |
| 4,426,276 | 1/1984 | Dean et al. | 208/70 |
| 4,495,063 | 1/1985 | Walters et al. | 208/113 |
| 4,523,987 | 6/1985 | Penick | 208/157 |
| 4,738,766 | 4/1988 | Fischer et al. | 208/89 |
| 4,789,457 | 12/1988 | Fischer et al. | 208/89 |
| 4,820,403 | 4/1989 | Gutberlet et al. | 208/111 |

*Primary Examiner*—Anthony McFarlane

*Attorney, Agent, or Firm*—Jack H. Park; Kenneth R. Priem; Richard A. Morgan

[57] ABSTRACT

In a two stage catalytic cracking process a heavy cycle gas oil fraction (HCGO) nominal boiling range 600° F. to 1050° F., API gravity of −10° to +10° and 65 to 95 vol % aromatics is recycled to extinction between an ebullated bed hydrocracking zone and fluidized catalytic cracking zone to yield a liquid fuel and lighter boiling range fraction as the light fraction from each zone.

The catalyst in the fluidized catalytic cracking zone is maintained at a micro activity 68 to 72 while cracking a virgin gas oil to HCGO. HCGO is then mixed with vacuum residuum and hydrocracked in an ebullated bed reactor. The mid range fraction is recycled to the fluidized catalytic cracking zone. The 1000° F.+ fraction is blended with a fuel oil.

16 Claims, 1 Drawing Sheet

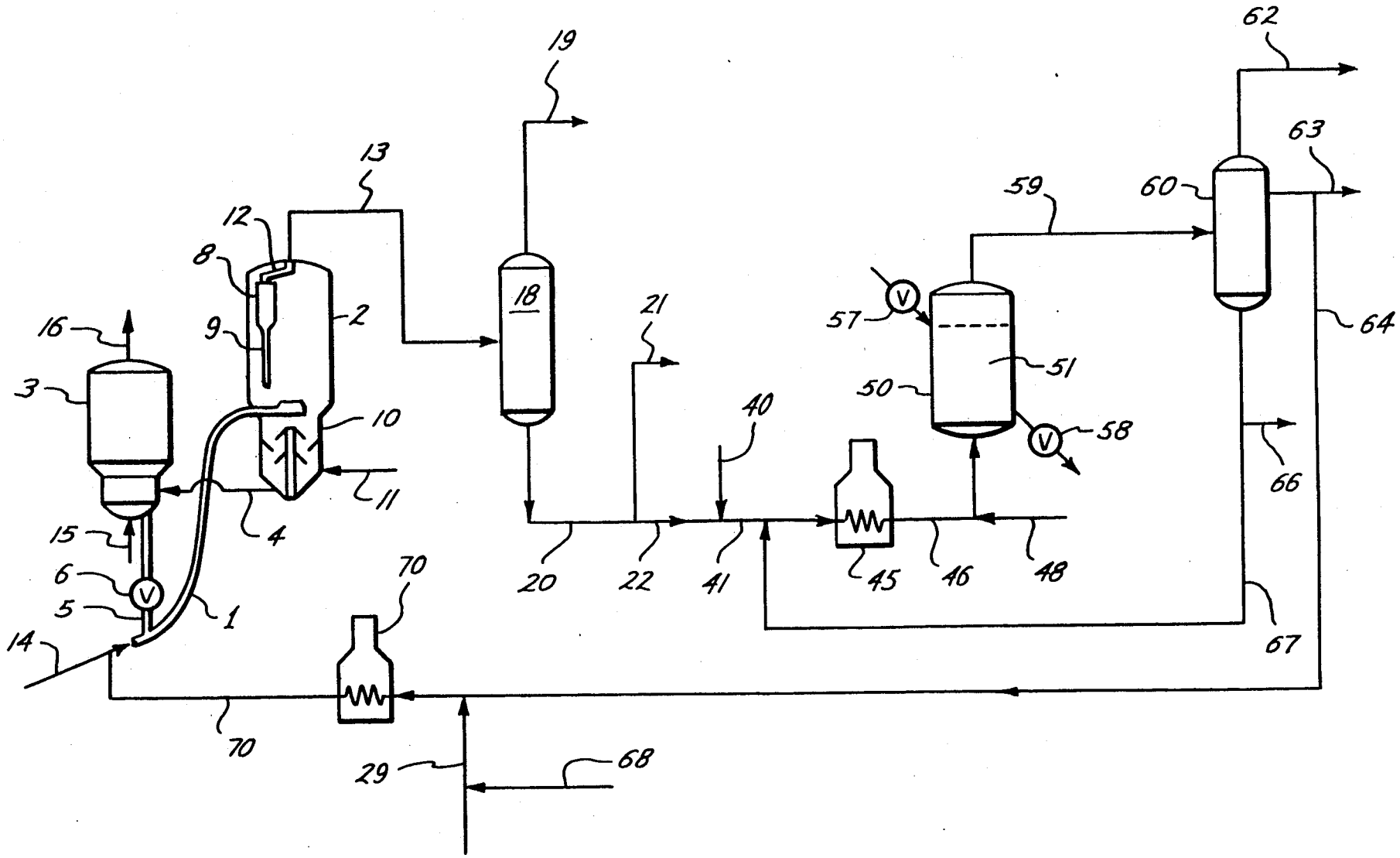
62
63
64
66
67
60
59
58
51
48
46
57
50
45
40
41
21
22
68
19
18
20
29
70
13
2
10
11
12
8
9
4
1
16
3
15
6
5
14

TWO CATALYST STAGE HYDROCARBON CRACKING PROCESS

BACKGROUND OF THE INVENTION

1. Field of the Invention

The invention relates to a two stage catalytic cracking process comprising both a fluidized catalytic cracking zone and an ebullated catalyst bed hydrocracking zone. More particularly, the invention relates to the serial catalytic cracking of a heavy cycle gas oil fraction boiling in the range of 600° F. to 1050° F. to yield a liquid fuel and lighter boiling range fraction.

2. Description of Other Relevant Methods in the Field

The ebullated bed process comprises the passing of concurrently flowing streams of liquids or slurries of liquids and solids and gas through a vertically cylindrical vessel containing catalyst. The catalyst is maintained in random motion in the liquid and has a gross volume dispersed through the liquid greater than the volume of the catalyst when stationary. This technology has found commercial application in the upgrading of heavy liquid hydrocarbons or converting coal to synthetic oils.

The process is generally described in U.S. Pat. No. Re. 25,770 to Johanson incorporated herein by reference. A mixture of hydrocarbon liquid and hydrogen is passed upwardly through a bed of catalyst particles at a rate such that the particles are forced into random motion as the liquid and gas flow upwardly through the bed. The random catalyst motion is controlled by recycle liquid flow so that at steady state, the bulk of the catalyst does not rise above a definable level in the reactor. Vapors along with the liquid which is being hydrogenated, pass through that upper level of catalyst particles into a substantially catalyst free zone and are removed at the upper portion of the reactor.

In an ebullated bed process the substantial amounts of hydrogen gas and light hydrocarbon vapors present rise through the reaction zone into the catalyst free zone. Liquid is both recycled to the bottom of the reactor and removed from the reactor as product from the catalyst free zone. The liquid recycle stream is degassed and passed through the recycle conduit to the recycle pump suction. The recycle pump (ebullation pump) maintains the expansion (ebullation) and random motion of catalyst particles at a constant and stable level.

A number of fluid catalytic cracking processes are known in the art. State of the art commercial catalytic cracking catalysts for these processes are highly active and possess high selectivity for conversion of selected hydrocarbon charge stocks to desired products. With such active catalysts it is generally preferable to conduct catalytic cracking reactions in a dilute phase transport type reaction system with a relatively short period of contact between the catalyst and the hydrocarbon feedstock, e.g. 0.2 to 10 seconds.

The control of short contact times, optimum for state of the art catalysts in dense phase fluidized bed reactors is not feasible. Consequently, catalytic cracking systems have been developed in which the primary cracking reaction is carried out in a transfer line or riser reactor. In such systems, the catalyst is dispersed in the hydrocarbon feedstock and passed through an elongated reaction zone at relatively high velocity. In transfer line reactor systems, vaporized hydrocarbon cracking feedstock acts as a carrier for the catalyst. In a typical upflow riser reactor, the hydrocarbon vapors move with sufficient velocity to maintain the catalyst particles in suspension with a minimum of back mixing of the catalyst particles with the gaseous carrier. Thus development of improved fluid catalytic cracking catalysts has led to the development and utilization of reactors in which the reaction is carried out with the solid catalyst particles in a relatively dilute phase with the catalyst dispersed or suspended in hydrocarbon vapors undergoing reaction, i.e., cracking.

With such riser or transfer line reactors, the catalyst and hydrocarbon mixture passes from the transfer line reactor into a first separation zone in which hydrocarbons vapors are separated from the catalyst. The catalyst particles are then passed into a second separation zone, usually a dense phase fluidized bed stripping zone wherein further separation of hydrocarbons from the catalyst takes place by stripping the catalyst with steam. After separation of hydrocarbons from the catalyst, the catalyst is introduced into a regeneration zone where carbonaceous residues are removed by burning with air or other oxygen-containing gas. After regeneration, hot catalyst from the regeneration zone is reintroduced into the transfer line reactor into contact with fresh hydrocarbon feed.

U.S. Pat. No. 3,905,892 to A. A. Gregoli teaches a process for hydrocracking a high sulfur vacuum residual oil fraction. The fraction is passed to a high temperature, high pressure ebullated bed hydrocracking reaction zone. The reaction zone effluent is fractionated into three fractions comprising (1) a 650° F.− fraction (light ends and middle distillates), (2) a 650° F. to 975° F. gas oil fraction and (3) a 975° F.+ heavy residual vacuum bottoms. The 650° F. to 975° F. gas oil fraction is passed to processing units such as a fluid catalytic cracking unit. The vacuum bottoms is deasphalted and the heavy gas oil fraction recycled to extinction in a fluid catalytic cracker described in the Abstract of the Gregoli patent.

U.S. Pat. No. 3,681,231 to S. B. Alpert et al teaches an ebullated bed process wherein a petroleum residuum feedstock containing at least 25 vol % boiling above 975° F. is blended with an aromatic diluent boiling within the range of 700° F. to 1000° F. and API gravity less than 16°. The aromatic diluent is blended in a ratio of 20 to 70 vol %, preferably 20 to 40 vol % diluent based on feed.

Aromatic diluents include decant oils from fluid catalytic cracking processes, syntower bottoms from Thermofor catalytic cracking operations, heavy coker gas oils, cycle oils from cracking operations and anthracene oil obtained from the destructive distillation of coal. It is stated that the 700° F. to 1000° F. gas oil generated in the process will in certain cases fall within the range of gravity and characterization factor and can serve as the aromatic feed diluent.

U.S. Pat. No. 3,412,010 to S. B. Alpert et al teaches an ebullated bed process wherein a petroleum residuum containing at least 25 vol % boiling above 975° F. is mixed with a recycle 680° F. to 975° F. fraction and passed to the ebullated reaction zone. It was found that the recycle of a 680° F. to 975° F. heavy gas oil resulted in a substantial lower yield of heavy gas oil in the 680° F. to 975° F. range and an increased yield of naphtha and furnace oil. Substantial improvement in operability was achieved as a result of reduction in asphaltenic precipitates.

U.S. Pat. No. 4,523,987 to J. E. Penick teaches a feed mixing technique for fluidized catalytic cracking of a hydrocarbon oil. The product stream of the catalytic cracking is fractionated into a series of products, including gas, gasoline, light gas oil and heavy cycle gas oil. A portion of the heavy cycle gas oil is recycled to the reactor vessel and mixed with fresh feed.

BRIEF DESCRIPTION OF THE DRAWING

In the drawing is a schematic process flow diagram for carrying out the invention.

DETAILED DESCRIPTION OF THE DRAWING

As shown in the drawing, the principle vessels include a riser reactor 1 in which substantially all of its volume contains a fluidized catalytic cracking zone. The fluidized catalytic cracking zone defines the region of high temperature contact between hot cracking catalyst and charge stock from line 7 in the presence of a fluidizing gas, termed lift gas, such as steam, nitrogen, fuel gas or natural gas, via line 14.

A conventional charge stock comprises any of the hydrocarbon fractions known to be suitable for cracking to a liquid fuel boiling range fraction. These charge stocks include light and heavy gas oils, diesel, atmospheric residuum, vacuum residuum, naphtha such as low grade naphtha, coker gasoline, visbreaker gasoline and like fractions from steam cracking is passed via line 29, fired furnace 70 and line 7 to riser reactor 1.

The fluidized catalytic cracking zone terminates at the upper end of riser reactor 1 in a disengaging vessel 2 from which cracking catalyst bearing a hydrocarbonaceous deposit, termed coke is passed. Vapors are diverted to cyclone separator 8 for separation of suspended catalyst in dip leg 9 and returned to vessel 2. The product vapors pass from cyclone separator 8 to transfer line 13.

Commercial cracking catalysts for use in a fluidized catalytic cracking process have been developed to be highly active for conversion of relatively heavy hydrocarbons into naphtha, lighter hydrocarbons and coke and demonstrate selectivity for conversion of hydrocarbon feed, such as vacuum gas oil, to a liquid fuel fraction at the expense of gas and coke. One class of such improved catalytic cracking catalysts includes those comprising zeolitic silica-alumina molecular sieves in admixture with amorphous inorganic oxides such as silica-alumina, silica-magnesia and silica-zirconia. Another class of catalysts having such characteristics for this purpose include those widely known as high alumina catalysts.

The separated catalyst in vessel 2 falls through a stripper 10 at the bottom of vessel 2 where volatile hydrocarbons are vaporized by the aid of steam passed through line 11. Steam stripped catalyst passes by standpipe 4 to a regenerator 3 specifically configured for combustion of coke by air injected at line 15. The regenerator 3 may be any of the various structures developed for burning coke deposits from catalyst. Air admitted to the regenerator 3 through line 15 provides the oxygen for combustion of the deposits on the catalyst, resulting in gaseous combustion products discharged via flue gas outlet 16. The regenerator is operated at a temperature of 1250° F. to 1370° F. to maintain high micro activity of the catalyst at 68 to 72, measured by ASTM D-3907 Micro Activity Test (MAT) or equivalent variation thereof such as the Davison Micro Activity Test. Regeneration to achieve this micro activity is accomplished by controlling riser 1 feed and outlet temperatures to the temperatures which provide the quantity of fuel as deposited coke to sustain the required regenerator 3 temperature. Valve 6 is controlled to maintain a selected riser 1 outlet temperature at a preset value. Fired heater 70 is adjusted to control the temperature of charge stock via line 7 to riser reactor 1. The temperature is reset as needed to maintain a desired temperature in regenerator 3.

Flue gas from the combustion of the coke on catalyst is discharged at flue 16 and the hot regenerated catalyst is returned to the riser reactor 1 by standpipe 5 through valve 6.

Product vapors in transfer line 13 are quenched and passed to fractionation column 18, here represented by a single column, but which in fact may be a series of fractionation columns which among other unit operations make the separation between normally gaseous fractions and liquid fuel fractions. Fractionation column 18 makes the essential separation in this invention between a liquid fuel and lighter boiling range fraction in line 19 and a heavy cycle gas oil fraction in line 20. Liquid fuel is a term well known to include light gas oil, gasoline, kerosene, diesel oil and may generally be described as having an end point of 600° F. to 740° F. depending on the crude source and on product demand. The heavy cycle gas oil fraction is of a quality wherein at least 80 vol % boils nominally in the range of 600° F. to 1050° F. The fraction most typically has an API gravity of from −10° to +20° and is about 65 to 95 vol % aromatic in composition.

Provision is made for removing a portion of the heavy cycle gas oil fraction through line 21 as reported in the Example. Preferably, the entire fraction is passed via line 22 and mixed with a conventional ebullated bed feedstock. Conventional feedstocks for the ebullated bed process include residuum such as petroleum atmospheric distillation bottoms, vacuum distillation bottoms, deasphalter bottoms, shale oil, shale oil residues, tar sands, bitumen, coal derived hydrocarbons, hydrocarbon residues, lube extracts and mixtures thereof. A conventional feedstock, preferably a vacuum residuum, is flowed through line 40 where it is mixed with the heavy cycle gas oil fraction from line 22 to form an ebullated bed feedstock mixture in line 41 and heated to 650° F. to 950° F. in fired heater 45.

The heated stock is passed through line 46 into ebullated bed reactor 50 along with a hydrogen containing gas via line 48. The ebullated bed reactor 50 contains an ebullated bed 51 of particulate solid catalyst. The reactor has provision for fresh catalyst addition through valve 57 and withdrawal of used catalyst through valve 58. Bed 51 comprises a hydrocracking zone at reaction conditions of 650° F. to 950° F. temperature, hydrogen partial pressure of 1000 psia to 4000 psia and liquid hourly space velocity (LHSV) within the range of 0.05 to 3.0 volume of feed/hour/reactor volume. Preferable ebullated bed catalyst comprises active metals, for example Group VIB salts and Group VIIIB salts on an alumina support of 60 mesh to 270 mesh having an average pore diameter in the range of 80 to 120 Angstroms and at least 50% of the pores having a pore diameter in the range of 65 to 150 Angstroms. Alternatively, catalyst in the form of extrudates or spheres of ¼ inch to 1/32 inch diameter may be used. Group VIB salts include molybdenum salts or tungsten salts selected from the group consisting of molybdenum oxide, molybdenum sulfide, tungsten oxide, tungsten sulfide and mixtures thereof. Group VIIIB salts include a nickel salt or cobalt salt selected from the group consisting of nickel oxide, cobalt oxide, nickel sulfide, cobalt sulfide and mixtures thereof. The preferred active metal salt combinations are the commercially available nickel oxide-molybdenum oxide and the cobalt oxide-molybdenum oxide combinations on alumina support.

The ebullated catalyst bed may comprise a single bed or multiple catalyst beds. Configurations comprising a single bed or two or three beds in series are well known in commercial practice.

Hot reactor effluent in line 59 is passed through a series of high pressure separators (not shown) to remove hydrogen, hydrogen sulfide and light hydrocarbons. This vapor is treated to concentrate hydrogen, compressed and recycled via line 48 to the ebullated bed 51 for reuse. The liquid portion is passed to fractionation column 60 represented as a single column, but which in practice may be a series of fractionation columns with associated equipment.

In representative fractionation column 60, a number of separations can be effected depending on the configuration and product demand. Though a larger number of fractions may be made, those functionally equivalent to the three essential fractions are considered to fall within the scope of this invention.

The first fraction is a liquid fuel and lighter boiling range fraction defined above, which is removed through line 62. The liquid fuel component includes diesel, gasoline and naphtha which depending on the refinery configuration, is routed to the same disposition as the fraction in line 19.

The second fraction is a heavy vacuum gas oil fraction with a nominal end point of about 950° F. to 1050° F. This fraction is essentially different from the heavy cycle gas oil fraction in line 20. This second fraction has been found to have an API gravity of 14° to 21° and is reduced in polyaromatic content by virtue of hydrotreating to comprise nominally 60 vol % aromatics.

The second fraction is combined via line 64 with a conventional fluid catalytic cracking charge stock via line 29 to form the charge stock via line 7 to riser reactor 1. In the best mode, charge stock via line 29 is hydrotreated. In the alternative, a portion may be hydrotreated and introduced via line 68 with unhydrotreated charge stock (Table III). In the alternative in the absence of third fraction described immediately below, a portion of the second fraction would be passed to tankage via line 63. Complete recycle of second fraction to riser reactor 1 could not be achieved in a commercial unit in the absence of the third fraction. Third fraction removed via line 66 was therefore found to be critical.

It has been discovered experimentally that when this third fraction termed heavy fuel oil, is removed, the total recycle of heavy cycle gas oil through line 64 to a fluid catalytic cracking riser reactor 1 can be accomplished. If this heavy fraction is not removed through line 66, a steady state recycle of the entire heavy cycle gas oil cannot be established between the fluidized catalyst riser reactor and the ebullated bed reactor. In such an unsteady state, heavy cycle gas oil concentration increased with time and steady state was reached only when heavy cycle gas was removed from the circuit via line 21.

The heavy fraction is of low refinery value and is passed through line 66 to any efficient disposition such to produce deasphalted oil, asphalt, coke or synthesis gas or to blend in bunker or other fuel oil. A portion of this stream may be recycled via line 67 to the ebullated bed reactor 50 to recycle unconverted heavy cycle gas oil to raise the conversion. The heavy fraction includes a small portion of this unconverted heavy cycle gas oil. The amount of unconverted heavy cycle gas oil in the heavy fraction depends on the cut point in fractionation column 60. In the Example, the amount of unconverted heavy cycle gas oil in line 66 ranged from 506 BPSD at a 1000° F. cut point to 1231 BPSD at a 970° F. cut point.

By processing the heavy cycle gas oil in the ebullated bed, the most fouling fraction of the unconverted heavy cycle gas oil (−7° API gravity, 20% Conradson Carbon Residue) was reduced thus reducing the poisoning rate of the FCCU catalyst.

SUMMARY OF THE INVENTION

A process has been discovered for hydrocracking a heavy cycle gas oil fraction to yield a liquid fuel boiling range and lighter fraction. The heavy cycle gas oil fraction, derived from fluidized catalytic cracking, is passed to an ebullated bed of particulate solid catalyst at a temperature in the range of 650° F. to 950° F., hydrogen partial pressure in the range of 1000 psia to 4000 psia and liquid hourly space velocity in the range of 0.05 to 3.0 vol feed/hr/vol reactor.

The hydrocracked ebullated bed effluent is separated into at least three fractions. The first is a liquid fuel and lighter boiling range fraction. The second is a heavy vacuum gas oil fraction of end point about 950° F. to 1050° F. The third is a heavy fraction boiling at temperatures above the second fraction.

The second, heavy gas oil fraction is mixed with a typical FCCU feedstock and passed to a fluidized catalytic cracking zone at a temperature of 800° F. to 1400° F., pressure of 20 psia to 45 psia and residence time in the range of 0.5 to 5 seconds. Catalyst is regenerated to maintain a micro activity by ASTM D-3907 or a test variation thereof such as the Davison Micro Activity Test, in the range of 68 to 72. Test variations which yield reproducible and consistent values for FCCU catalyst micro activity are acceptable equivalents within the scope of this invention. Tests are described in greater detail along with acceptable catalysts in U.S. Pat. No. 4,495,063 to P. W. Walters et al. incorporated herein by reference in its entirety.

The product of fluidized catalytic cracking is separated into at least two fractions. The first is a liquid fuel boiling range and lighter fraction. The second is a heavy cycle gas oil fraction.

An improved conversion of the 600° F. to 1050° F. heavy cycle gas oil fraction to the liquid fuel boiling range and lighter fraction is achieved, thereby converting a fraction of lesser fuel value to a liquid fuel fraction of greater fuel value.

This invention is shown by way of Example.

EXAMPLE 1

A test was conducted to illustrate the effect of recycling a heavy cycle gas oil fraction between an ebullated bed process and a fluidized catalytic cracking process. Two test runs were conducted on a commercial unit at a Gulf Coast refinery. The process flow is schematically shown in the Drawing. In the first run, complete recycle of heavy cycle gas oil could not be achieved. That is, 64.3 vol % of the heavy cycle gas oil was converted and the build up of heavy cycle gas oil in the circuit required the unconverted portion to be transferred to tankage via line 21. This conversion was achieved while fractionator 60 was making a 1000° F. resid cut.

A second test run conducted according to the invention demonstrated 82 vol % conversion of heavy cycle gas oil when the fractionator 60 was making a 970° F. resid cut. A conversion of 92.6 vol % is attainable if the cut point on fractionator 60 is raised to 1000° F. and could approach 95 to 98% conversion if the cut point were 1050° F. No heavy cycle gas oil was transferred to tankage and a steady state concentration of heavy cycle gas oil in the recycle circuit was achieved.

The operating conditions and yields are reported in Table I. Performance results are reported in Table II. Stream properties are reported in Table III.

TABLE I

| SUMMARY OF OPERATION | Run 1 | Run 2 |
|---|---|---|
| FCCU OPERATING CONDITIONS | | |
| Temperature, °F. | 955 | 945 |
| Hydrotreated Fresh Feed, vol % | 0 | 40* |
| Cat/Oil ratio, lb cat/lb oil | 6.8 | 4.4 |
| Riser Total pressure, psia | 37 | 37 |
| Riser Gas Composition, (inlet) | | |
| Hydrocarbon, mole % | 62 | 80 |
| Steam, mole % | 38 | 20 |
| Regenerator Temperature, °F. | 1295 | 1350 |
| Average Residence Time, sec. | 3.7 | 1.9 |
| Catalyst | Engelhard Octisiv Plus | Engelhard MS-380 |
| Catalyst Activity (MAT) | 62 | 72 |
| Fresh Feed to Riser, bbl/day (line 29) | 55200 | 66968 |
| Recycle HVGO to Riser, bbl/day (line 64) | 10070 | 16447 |
| EBULLATED BED OPERATING CONDITIONS | | |
| Temperature, °F. | 798 | 810 |
| Pressure, psia | 2770 | 2770 |
| LHSV, vol feed/time/vol empty reactor | 0.34 | 0.40 |
| Catalyst | Commercial Ni—Mo Extrudates | |
| Number of trains | 1 | 2 |
| Fresh Feed To Reactor, bbl/day (line 40) | 18570 | 45756 |
| HCGO to Ebullated Bed, 650° F.+, bbl/day (line 22) | 3841 | 6840 |
| PRODUCT YIELDS | | |
| LCGO and Lighter 650° F. EP, bbl/day (line 19) | 62137 | 88420 |
| HCGO from FCCU 650° F.+, bbl/day (line 20) | 9856 | 6840 |
| HCGO to Tankage, bbl/day (line 21) | 6015 | 0 |
| Liquid Fuel and Lighter 650° F. EP, bbl/day (line 62) | 6379 | 19267 |

TABLE I-continued

| SUMMARY OF OPERATION | Run 1 | Run 2 |
|---|---|---|
| Heavy Fuel Oil, bbl/day (line 66) | 8141 | 22901 |
| HCGO in Heavy Fuel Oil, bbl/day (line 66) | | |
| @ 970° F. cut pt. | — | 1231 |
| @ 1000° F. cut pt. | 1371 | 506 |

*Hydrotreated Virgin Gas Oil - catalytically hydrotreated @ 500 psia, 750° F. 78% hydrodesulfurization (HDS) - TABLE III In the best mode contemplated by inventors at the time this application was filed, virgin FCCU feedstock is catalytically hydrodesulfurized prior to mixing with heavy cycle gas oil. In this example 40 vol % was hydrodesulfurized.

TABLE II

| SUMMARY OF PERFORMANCE RESULTS CONVERSION OF HCGO IN COMBINED EBULLATED BED-FCCU | Run 1 | Run 2 |
|---|---|---|
| RESID CONVERSION IN EBULLATED BED 1000° F.+ Conversion, vol % | 52 | 55 |
| Gas Oil Conversion in FCCU, vol % | 68.5 | 70.1 |
| HCGO Charged to Ebullated Bed, bbl/day (line 22) | 3841 | 6840 |
| 1000° F.+ HCGO From Ebullated Bed, bbl/day | 1371 | 506 |
| FCCU Catalyst MAT Activity (DAVISON Micro Activity) | 62 | 72 |
| HCGO Conversion in Combined Ebullated Bed/FCCU, vol % | 64.3 | 92.6 |

LCGO - light cycle gas
HCGO - heavy cycle gas oil
HVGO - heavy vacuum gas oil
FCCU - fluid catalytic cracking unit
LHSV - liquid hourly space velocity

TABLE III

| Material | Virgin* Hydrotreated Gas Oil (line 68) | Feedstock Properties: Virgin + Hydrotreated Gas Oil (line 29) | FCCU Feed (line 7) | Heavy Gas Oil (Line 64) | Heavy Cycle Gas Oil (Line 20) | Hydro-** treated HCGO | Vacuum Resid (Line 40) |
|---|---|---|---|---|---|---|---|
| API Gravity | 25.7° | 23.8° | 22.2° | 16.0° | −3.0° | 0.5° | 4.5° |
| Sulfur, wt % | 0.57 | 1.6 | 1.41 | 0.7 | 2.83 | 0.72 | 4.1 |
| Nitrogen, wppm | 965 | 1233 | 1503 | 2550 | 1400 | 910 | 4380 |
| Conradson Carbon Residue, (ASTM D-4530-85), wt % total carbon residue | 0.1 | 0.14 | 0.14 | 0.16 | 9.27 | 0.2 | 21.6 |
| Aromatics, wt % | — | 43 | 47 | — | — | — | — |
| V, wppm | >1 | — | — | — | — | — | 133 |
| Ni, wppm | >1 | — | — | — | — | — | 49 |
| HCGO Distillation | | | | | | | |
| IBP - 650° F. | 6.8 vol % | | | | | | |
| 650° F.–1000° F. | 81.7 vol % | | | | | | |
| 1000° F.+ | 11.5 vol % | | | | | | |

*Catalytically hydrotreated @ 500 psia, 750° F.
**Calculated product of passing Heavy Cycle Gas Oil (Line 20) through bed 51 at reaction conditions Typically, heavy cycle gas oil produces poor yields of liquid fuels in a fluid catalytic cracking process. After hydrotreating in an ebullated bed reactor, liquid fuel yields (Table III) are still worse than a typical fluid catalytic cracking process feedstock. However, the two catalyst stage process converted 64.3% at an FCCU catalyst MAT activity of 62. By increasing the FCCU catalyst MAT activity to 72, conversion of the HCGO increased to 92.6%.

The mechanism of this invention is not full understood, but the combined operation produced results which are fully reproducible on a commercial unit.

EXAMPLE 2

A virgin vacuum gas oil (VGO) was cracked in a fluidized catalytic cracking process. The reaction product was fractionated to yield a heavy cycle gas oil (HCGO) which was mixed with a vacuum residuum fraction and passed to an ebullated bed reactor. Table IV summarizes the effect of diluent on the API gravity, sulfur content and vanadium content of the 1000° F.+ resid product.

TABLE IV

| | Run 1 | Run 2 | Run 3 |
|---|---|---|---|
| Operation | without HCGO | with HCGO | with HCGO |
| Unit | pilot | pilot | commercial |
| HCGO API Gravity | — | 18° | −3° |
| Resid Sulfur, wt % | 3.96 | 3.96 | 4.24 |
| Resid Vanadium, wppm | 102 | 102 | 160 |
| Ebullated Bed LHSV | | | |
| Vol feed/hr/vol reactor | 0.28 | 0.33 | 0.41 |
| HCGO/Vacuum Resid, vol/vol | 0/100 | 20/80 | 15/85 |
| Rx Average Reactor Temperature, °F. | 774 | 792 | 810 |
| 1000° F.+ Conversion, vol % | 46 | 54 | 55 |
| Heavy Fuel Oil Fraction (line 66) | | | |
| Sulfur, wt % | 1.73 | 1.12 | 2.04 |
| Vanadium, wppm | 48 | 18 | 59 |

There is a slight difference in operating conditions and feedstock among these three runs. The temperature and LHSV in runs 2 and 3 were higher than those in case 1 and sulfur and metals of run 3 were higher than those of runs 1 and 2. The data were adjusted using ebullated bed correlations to the same operating conditions and feedstock quality. The correlation adjustment basis and resulting heavy fuel oil quality are reported here:

TABLE V

| | Run 1 | Run 2 | Run 3 |
|---|---|---|---|
| Vacuum Resid sulfur, wt % | 3.96 | 3.96 | 3.96 |
| Vacuum Resid vanadium, wppm | 102 | 102 | 102 |
| Temperature, °F. | 792 | 792 | 792 |
| LHSV, Vol/Hr/Vol | 0.28 | 0.28 | 0.28 |
| Heavy Fuel Oil Fraction (line 66) | | | |
| Sulfur, wt % | 1.51 | 0.99 | 1.74 |
| Vanadium, wppm | 48 | 18 | 38 |

The inventive process demonstrates an improvement in sulfur and vanadium removal from a residual feedstock when processing in an ebullated bed reactor with a high aromatic feedstock having API gravity of about 18°. For feedstocks having a gravity less than 0° API, there was no improvement in desulfurization and only moderate improvement in vanadium removal.

EXAMPLE 3

Test runs were conducted in a commercial unit to demonstrate reduced sedimentation by mixing a heavy cycle gas oil with the vacuum resid feedstock to an ebullated catalyst bed. Sludge formed in the reaction deposits in downstream equipment and can plug process lines causing shut-down of the unit. The amount of sediment is measured by the Shell Hot Filtration Test (SHFT). It is our understanding that this test is ASTM D-4870. The results are summarized below:

TABLE VI

| FEEDSTOCK PROPERTIES: | Run 1 | Run 2 |
|---|---|---|
| API Gravity | 5.2° | 3.4° |
| Sulfur, wt % | 4.1 | 4.1 |
| Vanadium, wppm | 128 | 142 |
| Nickel, wppm | 51 | 47 |
| Conradson Carbon Residue, wt % (ASTM D-4530-85) | 22.6 | 20.1 |

TABLE VI-continued

| FEEDSTOCK PROPERTIES: | Run 1 | Run 2 |
|---|---|---|
| HCGO In the Feed Blend, vol % | 0 | 13 |
| 1000° F.+ Conversion, vol % | 55.3 | 55.1 |
| SHFT, wt % sediment | 0.36 | 0.19 |

What is claimed is:

1. A process for catalytically cracking a heavy cycle gas oil fraction derived from a fluidized catalytic cracking zone to yield a liquid fuel and lighter boiling range fraction, (a) passing the heavy cycle gas oil fraction, and a hydrogen-containing gas upwardly through a bed of ebullated particulate solid catalyst in an ebullated hydrocracking zone at a temperature in the range of 650° F. to 950° F., hydrogen partial pressure in the range of 1000 psia to 4000 psia and liquid hourly space velocity of 0.05 to 3.0 vol feed/hr/vol reactor, (b) separating the hydrocracked product of step (a) into at least three fractions comprising:

(i) a first, liquid fuel and lighter boiling range fraction, (ii) a second, heavy vacuum gas oil fraction of end point about 950° F. to 1050° F., and (iii) a third, heavy fuel oil fraction, boiling at temperatures above said second, heavy vacuum gas oil fraction, (c) passing said second, heavy vacuum gas oil fraction to a fluidized catalytic cracking zone comprising fluidized cracking catalyst at a temperature of 800° F. to 1400° F., pressure of 20 psia to 45 psia, residence time in the range of 0.5 to 5 seconds, said fluidized cracking catalyst having a micro activity of 68 to 72;

(d) separating the cracked product of step (c) into at least two fractions comprising:

(i) a first, liquid fuel and lighter boiling range fraction, and (ii) a second, heavy cycle gas oil fraction.

2. The process of claim 1 wherein said heavy cycle gas oil of step (a) has an API gravity of −10° to +10°.

3. The process of claim 1 wherein at least 80 vol % of said heavy cycle gas oil fraction of step (a) boils in the range of 600° F. to 1050° F.

4. The process of claim 1 wherein in step (a) the heavy cycle gas oil fraction comprises 5 vol % to 40 vol % of the hydrocarbon passed through said zone.

5. The process of claim 1 wherein in step (c) conversion of the heavy vacuum gas oil fraction ranges from 50% to 98%.

6. The process of claim 1 wherein in step (c) the fluidized cracking catalyst is taken from a regeneration zone wherein regeneration temperature ranges from 1250° F. to 1370° F.

7. The process of claim 1 wherein in step (c) the heavy vacuum gas oil comprises 5 vol % to 40 vol % of the hydrocarbon passed to the fluidized catalytic cracking zone.

8. The process of claim 1 wherein in step (c) additionally, virgin vacuum gas oil is passed to said fluidized catalytic cracking zone.

9. The process of claim 1 wherein in step (b)(iii) the heavy fuel oil fraction has an initial boiling point of 600° F. or higher.

10. The process of claim 1 wherein in step (b)(iii) the heavy fuel oil fraction has an initial boiling point of 1000° F. or higher.

11. The process of claim 1 wherein in step (b) separating is by vacuum distilling.

12. The process of claim 1 wherein in step (d) separating is by distilling.

13. The process of claim 1 wherein in step (a) the ebullated hydrocracking zone comprises a single bed of catalyst.

14. The process of claim 1 wherein in step (a) the ebullated hydrocracking zone comprises two or more beds of catalyst in series.

15. The process of claim 1 wherein heavy cycle gas oil fraction of step(d)(ii) is passed to the ebullated hydrocracking zone of step (a).

16. The process of claim 1 wherein the entire heavy cycle gas oil fraction of step(d)(ii) is passed to the ebullated hydrocracking zone of step (a).

* * * * *

UNITED STATES PATENT AND TRADEMARK OFFICE

CERTIFICATE OF CORRECTION

PATENT NO. : 5,108,580

DATED : April 28, 1992

INVENTOR(S) : Govanon Nongbri, et al.

It is certified that error appears in the above-identified patent and that said Letters Patent is hereby corrected as shown below:

Column 10

Claim 1, line 3, after "fraction," insert --comprising:--.

Signed and Sealed this

Twenty-ninth Day of June, 1993

Michael K. Kirk

*Attest:*

MICHAEL K. KIRK

*Attesting Officer*

*Acting Commissioner of Patents and Trademarks*